US005798743A

United States Patent [19]

Bloom

[11] Patent Number: 5,798,743

[45] Date of Patent: Aug. 25, 1998

[54] CLEAR-BEHIND MATRIX ADDRESSING FOR DISPLAY SYSTEMS

[75] Inventor: David M. Bloom, Portola Valley, Calif.

[73] Assignee: Silicon Light Machines, Sunnyvale, Calif.

[21] Appl. No.: 482,192

[22] Filed: Jun. 7, 1995

[51] Int. Cl.[6] ..... G09G 3/36

[52] U.S. Cl. ..... 345/90; 345/149

[58] Field of Search ..... 345/98, 94, 89, 345/97, 90, 147–149

[56] References Cited

U.S. PATENT DOCUMENTS

| | | | |
|---|---|---|---|
| 3,947,105 | 3/1976 | Smith | 353/121 |
| 4,009,939 | 3/1977 | Okano | 350/162 SF |
| 4,017,158 | 4/1977 | Booth | 350/162 SF |
| 4,067,129 | 1/1978 | Abramson et al. | 40/563 |
| 4,093,346 | 6/1978 | Nishino et al. | 350/162 SF |
| 4,139,257 | 2/1979 | Matsumoto | 350/6.1 |
| 4,163,570 | 8/1979 | Greenaway | 283/8 A |
| 4,184,700 | 1/1980 | Greenaway | 283/6 |
| 4,211,918 | 7/1980 | Nyfeler et al. | 235/454 |
| 4,223,050 | 9/1980 | Nyfeler et al. | 427/163 |
| 4,250,217 | 2/1981 | Greenaway | 428/161 |
| 4,250,393 | 2/1981 | Greenaway | 250/566 |
| 4,408,884 | 10/1983 | Kleinknecht et al. | 356/355 |
| 4,440,839 | 4/1984 | Mottier | 430/2 |
| 4,492,435 | 1/1985 | Banton et al. | 350/360 |
| 4,556,378 | 12/1985 | Nyfeler et al. | 425/143 |
| 4,596,992 | 6/1986 | Hornbeck | 346/76 PH |
| 4,655,539 | 4/1987 | Caulfield et al. | 350/3.6 |
| 4,709,995 | 12/1987 | Kuribayashi et al. | 345/89 |
| 4,747,671 | 5/1988 | Takahashi et al. | 345/97 |
| 4,751,509 | 6/1988 | Kubota et al. | 340/784 |
| 4,761,253 | 8/1988 | Antes | 264/1.3 |
| 4,797,918 | 1/1989 | Lee et al. | 348/3 |
| 4,856,869 | 8/1989 | Sakata et al. | 350/162.18 |
| 4,915,463 | 4/1990 | Barbee, Jr. | 350/1.1 |
| 4,984,824 | 1/1991 | Antes et al. | 283/91 |
| 5,035,473 | 7/1991 | Kuwayama et al. | 350/3.7 |
| 5,058,992 | 10/1991 | Takahashi | 359/567 |
| 5,089,903 | 2/1992 | Kuwayama et al. | 359/15 |
| 5,101,184 | 3/1992 | Antes | 235/454 |
| 5,132,812 | 7/1992 | Takahashi et al. | 359/9 |
| 5,155,604 | 10/1992 | Miekka et al. | 359/2 |
| 5,231,388 | 7/1993 | Stoltz | 340/783 |
| 5,291,317 | 3/1994 | Newswanger | 359/15 |
| 5,301,062 | 4/1994 | Takahashi et al. | 359/567 |
| 5,311,360 | 5/1994 | Bloom et al. | 359/572 |
| 5,347,433 | 9/1994 | Sedlmayr | 362/32 |
| 5,363,220 | 11/1994 | Kuwayama et al. | 359/3 |

OTHER PUBLICATIONS

R. Apte, F. Sandejas, W. Banyai, D. Bloom, "Grating Light Valves For High Resolution Displays", Ginzton Laboratories, Stanford University, Stanford, CA 94305–4085.

R. Apte, *Grating Light Valves For High Resolution Displays* Jun., 1994.

O. Solgaard, *Integrated Semiconductor Light Modulators For Fiber–Optic And Display Applications*, Feb., 1992.

J. Neff, "Two–Dimensional Spatial Light Modulators: A Tutorial", *Proceedings of the IEEE*, vol. 78, No. 5 (May 1990), pp. 826–855.

Gerhard–Multhaupt, "Viscoelastic Spatial Light Modulators and Schlieren–Optical Systems for HDTV Projection Displays", *SPIE* vol. 1255 *Large Screen projection Displays II* (1990), pp. 69–78.

Gerhard–Multhaupt, "Light–Valve Technologies for High–Definition Television Projection Displays", *Displays*, vol. 12, No. 3/4 (1991), pp. 115–128.

*Primary Examiner*—Amare Mengistu

*Attorney, Agent, or Firm*—Haverstock & Owens LLP

[57] ABSTRACT

A display system uses a weighted PWM scheme to deliver control during a frame time for developing a plurality of grayscale levels in each of a plurality of pixels. Of all the weighted subframes, a predetermined number of the shortest subframes utilize a like subframe duration. However, to provide additional levels of grayscale, differing durations of 'on' time are utilized in these like subframes. Thus, all but one of these like-time subframes has a dead zone time during which the pixels are never activated. A clear circuit turns 'off' the illuminated pixels during the dead zone time.

11 Claims, 2 Drawing Sheets

CLEAR-BEHIND MATRIX ADDRESSING FOR DISPLAY SYSTEMS

FIELD OF THE INVENTION

This invention relates to the field of pulse-width modulation for providing grayscale differentiation for displays. More particularly, the present invention is for a modified pulse-width modulation technique which provides very short 'on' times without requiring a commensurate increase in electrical bandwidth.

BACKGROUND OF THE INVENTION

When displaying an image on a digital display, a pixel is either 'on' or 'off'. To formulate a more variable image it is desirable to provide selectable grayscale. Such increased variability can be used to provide more information or more realism in an image. For example, consider a display where an 'on' pixel is white and an 'off' pixel is black. To achieve an in-between state, eg., gray, the pixel can be toggled equally between 'on' and 'off'. The eye of the average viewer automatically integrates this toggled pixel to perceive a gray image rather than black or white. To achieve a lighter or darker gray, the duty cycle for toggling the pixel can be adjusted to be on more or less of the time, respectively. It is well understood that such grayscale techniques can also apply to color systems to formulate varying intensities of color. Nevertheless, to avoid unnecessarily obscuring the invention in extraneous detail, the remainder of this disclosure will only discuss whites, blacks and varying levels of grays. It will be understood that colors are also contemplated within the teachings of the present invention.

The technique described immediately above is known conventionally as pulse-width modulation (PWM). It is well known to implement a PWM scheme as either unweighted or weighted. FIG. 1 illustrates a conventional 3-bit unweighted scheme. According to the unweighted scheme a pixel cycle, commonly known as a frame, is divided into seven equal duration time slots, or subframes. The pixel can be activated during any number of the subframes from zero through seven. For typical frames, the intensity of the pixel is completely dependent upon the duration the pixel is 'on'. The same intensity will be achieved when activating only a single subframe regardless of which of the subframes is used. Similarly, the same intensity will be achieved where four subframes are activated whether the first four, last four or alternating subframes are activated. Thus, in the system of FIG. 1, there are eight intensity levels ranging from having the pixel 'off' in all the subframes to having the pixel 'on' in all the time slots.

FIG. 2 illustrates a conventional weighted 8-bit PWM scheme. In a weighted scheme, each subframe has a distinct duration. In a conventional weighted scheme such as shown in FIG. 2, each subframe has twice the duration of the successive subframe. In this way, the intensity of the pixel can be selected using conventional binary counting. Thus, the scheme illustrated in FIG. 2 can select among 256 (0 to 255) levels of grayscale from black to white. In the general weighted case, the frame-time is divided into N subframes, with the duration of each subframe selected by the weight of the bit. In an N-bit system, the frame-time is weighted by $1/2^n$ where n={0,N} and the sum of all intervals is $1/2+1/4+\ldots+1/2^N=(2^N-1)/2^N$. The shortest duration subframe, corresponding to the least significant bit, is frame-time/$(2^N-1)$.

A digital display system includes a plurality of pixels arranged in an array of rows and columns. One conventional system includes 1024 rows of pixels, each having 1280 pixels arranged in columns. A row of 1280 registers is loaded with the display data. For a PWM system, shift registers are used to sequentially store the data for a row of pixels. Data can be fed into the shift registers serially or in parallel; for convenience, the serial case is considered. The time available for loading a row of data into the shift registers is Λ/(# of rows)/(# of columns). Therefore, the required data bus bandwidth for the electronics supplying data to the shift registers is (# of rows)(# of columns)/Λ. This means that the bandwidth of the data bus doubles for every bit of grayscale that is added to a system. It is well understood that the cost of a system can increase significantly with increased bandwidth.

If the duration of the shortest subframe is Λ, then the duration available for turning on the pixel is Λ/(# of rows of pixels), since rows are addressed sequentially. In addition, the operating frequency of a system that provides the control signals to such pixels must be (# of rows of pixels)/Λ (assuming the control timing for turning on the pixel is the same as for turning off the pixel). As the duration of the shortest subframe becomes smaller, the design of control circuitry with sufficient bandwidth becomes increasingly difficult.

It is well understood that the bandwidth cannot be reduced by simply lengthening the duration of all the subframes. Consider for example where a grayscale of ½ is desired. If the duration of the frame and appropriate subframe are sufficiently long, the displayed pixel(s) will appear to flicker rather than appear as an intermediate gray level. Thus, it is important that the display time for any of the subframes not be too long.

What is needed is a display system that provides grayscale using a weighted PWM scheme which does not flicker and without significantly increasing the bandwidth requirements of the associated control circuitry and data bus.

SUMMARY OF THE INVENTION

A display system uses a weighted PWM scheme to deliver control during a frame time for developing a plurality of grayscale levels in each of a plurality of pixels. Of all the weighted subframes, a predetermined number of the shortest subframes utilize a like subframe duration. However, to provide additional levels of grayscale, differing durations of 'on' time are utilized in these like subframes. Thus, all but one of these like-time subframes has a dead zone time during which the pixels are not activated. A separate control signal recognized as a clear circuit turns 'off' the illuminated pixels during the dead zone time.

In the preferred embodiment, the frame includes eight subframes. Each of the subframes is conditioned to activate the display for a unique duration. The first subframe turns its respective pixel 'on' for a predetermined length of time and each subsequent subframe for one-half the duration of its immediate predecessor. However, each of the last four subframes, subframes 5, 6, 7 and 8, have a same duration, one to the other. To maintain the condition that each successive subframe has one-half the duration of its immediate predecessor, the subframes 6, 7 and 8, each have a dead zone in which the pixels are never turned on. The dead zone in subframe 6 is ½ the subframe duration. The dead zone in subframe 7 is ¾ the subframe duration and the dead zone in subframe 8 is ⅞ the subframe duration. A clear circuit is provided which provides the necessary counting capability to turn off the illuminated pixels at the appropriate times during the subframes 6, 7 and 8.

DETAILED DESCRIPTION OF THE PREFERRED EMBODIMENT

Figure 1:
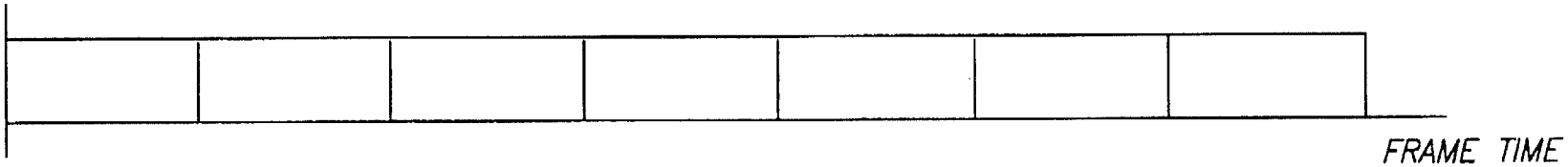
FIG. 1 (PRIOR ART)
FIG. 1 shows a timing diagram for an unweighted PWM scheme in the prior art.
Figure 2:
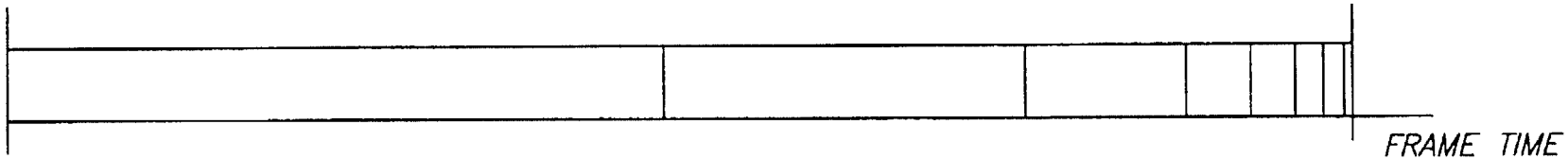
FIG. 2 (PRIOR ART)
FIG. 2 shows a timing diagram for a weighted PWM scheme in the prior art.
Figure 3:
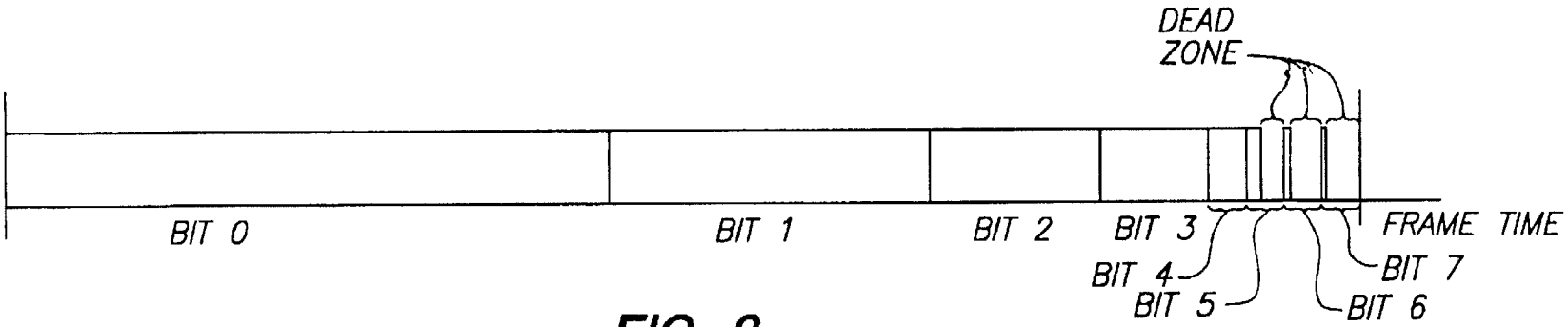
FIG. 3 shows a timing diagram for a weighted PWM scheme according to the present invention.

FIG. 3 shows a timing diagram for the weighted PWM scheme according to the present invention. The invention is directed toward developing a grayscale display capability in a digital display. A single frame time is illustrated in FIG. 3. In this preferred embodiment, there are eight subframes and thus eight bits of selectability for grayscale. This provides 256 unique gray levels from fully off to nearly fully on. As will be appreciated from the discussion below, because of certain features of this invention, a small portion of available light (about 6% in the preferred embodiment) will be lost. This is true even when all of the bits are 'on'.

The most significant bit is provided first according to the preferred embodiment. The subframe for the first bit, Bit 0, has a duration for a predetermined amount of time. A similar weighted PWM scheme according to the prior art would have a duration for controlling the pixel for 50% of the frame time for Bit 0. In the present invention, Bit 0 controls the pixel for slightly more than 47% of the frame time. Bit 1 controls the pixel for ½ the duration of Bit 0. Similarly, Bit 2 controls the pixel for ½ the duration of Bit 1, Bit 3 controls for ½ of Bit 2, Bit 4 controls for ½ of Bit 3, Bit 5 controls for ½ of Bit 4, Bit 6 controls for ½ of Bit 5, and Bit 7 controls for ½ of Bit 6.

According to the preferred embodiment, each of the bits falls within one of eight subframes. Bit 0 through Bit 4 each entirely fill their respective subframes. If two of these bits are utilized to achieve a particular grayscale, the 'off' signal at the end of the first such subframe is deactivated so that the pixel remains 'on'.

As shown in FIG. 3, Bit 5 through Bit 7 each have the same subframe duration time as Bit 4. For Bit 5, the pixel receives a control signal to turn the pixel 'off' ½ the way through the subframe. For Bit 6, the pixel receives a control signal to turn the pixel 'off' ¼ the way through the subframe. For Bit 7, the pixel receives a control signal to turn the pixel 'off' ⅛ the way through the subframe. The portion of each of the subframes for Bit 5 though Bit 7 is a dead zone during which time no pixel is 'on'. These dead zones do decrease the total amount of illumination available from each pixel by approximately 6%. However, because the time duration of bit 7 is maintained at the time duration of bit 4, the bandwidth of the control system need not operate at as high a frequency as would otherwise be necessary and does not need to be fed into the shift register as fast as would otherwise be necessary.

The following illustrates one example for achieving 8-bit grayscale with 5-bit timing. The technique can be generalized to N-bit grayscale timing with M-bit timing, where M<N. It is assumed that the display is digital and has 1024 rows with 1280 columns operating at a 75 Hz frame rate.

To achieve 8-bit grayscale, 8 subframes are required corresponding to bits 0 through 7. The timing corresponds to ½, ¼, ⅛, 1/16, 1/32, 1/64, 1/128 and 1/256 of a total frame-time as described in the prior art. In actuality according to the teachings of the present invention, the frame is divided into eight subframes which correspond to ½, ¼, ⅛, 1/16, 1/32, 1/32, 1/32 and 1/32.

The three least significant bits, Bit 5 through Bit 7, are generated by subdividing the last three subframes into ½, ¼ and ⅛ of the 1/32 subframes to yield 1/64, 1/128 and 1/256, respectively. This occurs by turning off a row of pixels after it has been on ½, ¼ and ⅛ of the 1/32 subframes. It will be apparent that some of the intensity is lost even when all bits are on: approximately 6%.

The 1/32 subframes (Bit 4 through Bit 7) defines the speed required for addressing, the time it takes to write 1024 rows, since it corresponds to the shortest subframe. The time required in this example for the 1/32 subframe is $$t(1/32 \text{ bit})=(1/f)(32/34)(1/32)$$

For f=75 Hz, t=392 μs. The time allowed to write each row is then $$t_{ROW}=t/\rho; \text{ where } \rho=\text{number of pixels per row.}$$

For this example with 1024 pixels per row, the timing is 383 ns per pixel.

For all grayscale bits, the time to address 1024 rows is 392 μs

Figure 4:
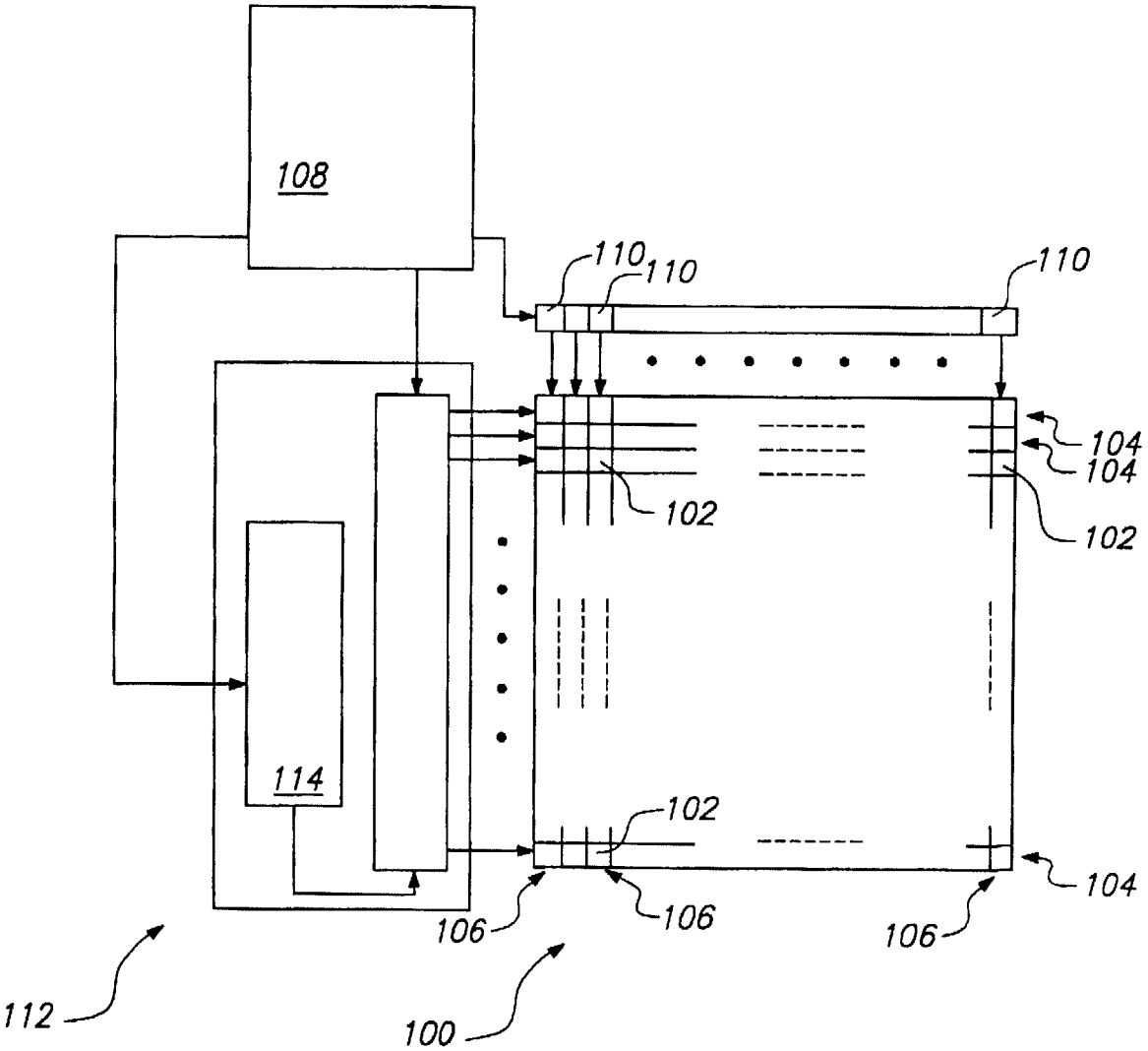
FIG. 4 shows a block diagram of system architecture for implementing the present invention.
Figure 4:
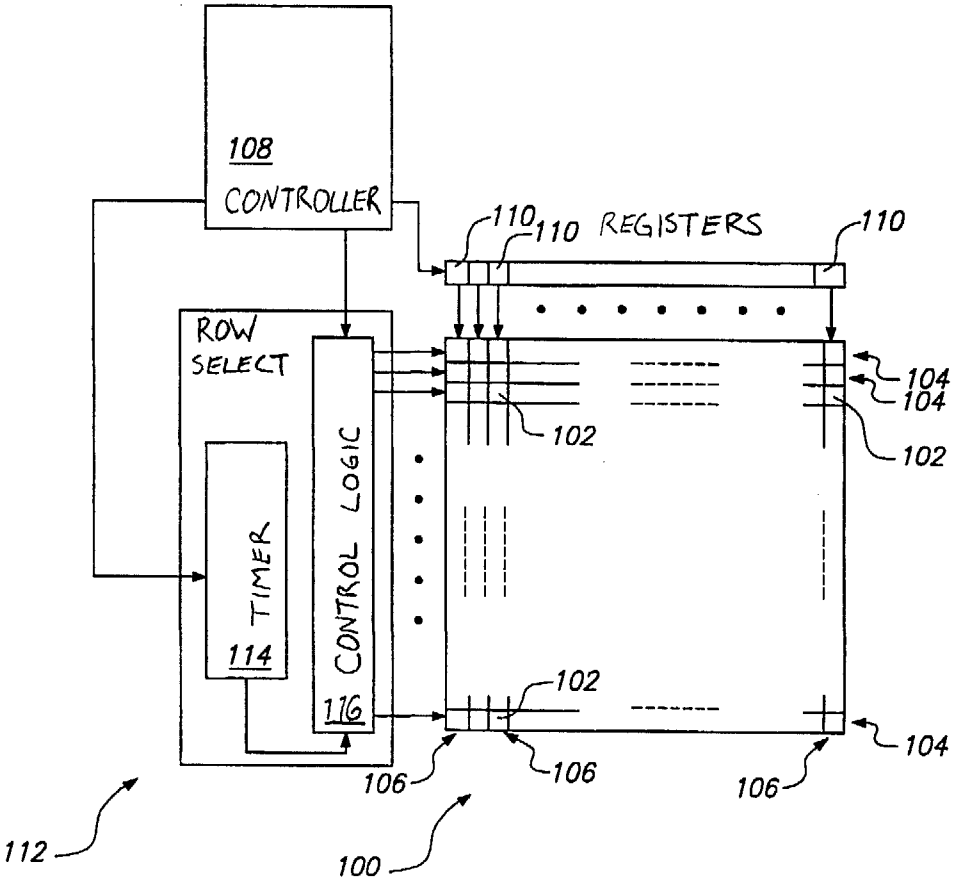

FIG. 4 shows a block diagram of a display system according to the present invention. An array 100 of a plurality of discreet pixels is arranged in a plurality of rows 104 and columns 106. Each row contains a predetermined number of pixels. One commercially available display includes 1024 rows, each having 1280 pixels per row. Other sizes of displays are also available.

A control circuit 108 is coupled to load display data into a plurality of registers 110. There are the same number of registers 110 as pixels 102 in a row 104. In the preferred embodiment, the data is entered into a first register and shifted through the row of registers like a standard shift register. It is well known that other means for loading the registers can be used. The control circuit 108 is also coupled to a row select circuit 112. One function of the row select circuit is to condition the array 100 to transfer the display data from the registers 1 10 into a predetermined row 104 of pixels 102.

To display a particular grayscale image in a row, the data for Bit 0 for each pixel 102 in the selected row 104 is loaded into the registers 110. Once the data is loaded, the control circuit 108 generates a control signal to initiate the transfer of the data to the row 104 of pixels 102 that is selected by the row select circuit 112. The control circuit 108 also provides the row select circuit 112 information regarding which bit of the grayscale is being transmitted to the pixels 102 for display.

The row select circuit 112 incorporates a timer circuit 114 which counts down the desired duration of bit being displayed. Once the full duration has been displayed, the timer circuit 114 generates an off signal which is coupled to the appropriate row 104. Control logic 116 is incorporated in the timer circuit 114 which inhibits the off signal in the event two consecutive bits are required for the generation of a grayscale. Of course, the inhibit function does not operate for those bits that include a dead zone because the control logic of the timer circuit 114 has been programmed using digital circuitry to reserve bits 5,6, and 7 as bits that include a dead zone or are of partial duration.

The present invention has been described relative to a preferred embodiment. Improvements or modifications that become apparent to persons of ordinary skill in the art only after reading this disclosure are deemed within the spirit and scope of the application.

What is claimed is:

1. A method of providing data bits to a display comprising an array of pixels arranged in a plurality of rows each having a like number of pixels for forming a grayscale image, the method comprising the steps of:

a. providing a plurality of weighted data bits to each pixel within a frame-time;

b. subdividing the frame-time into a plurality of subframes such that one of the weighted data bits is provided to each pixel during one of the subframes and further wherein each of the pixels is controlled by an appropriate one of the weighted data bits during an entire duration of a first portion of the subframes and during a partial duration of a second portion of the subframes;

c. providing a turn-off signal at an end of each subframe;

d. inhibiting the turn-off signal for two consecutively asserted bits; and e. disabling the step of inhibiting for the second portion of the subframes.

2. An apparatus for forming a weighted grayscale display, comprising:

a. an array of pixels arranged in a plurality of rows each having a like number of pixels;

b. means for providing a plurality of weighted data bits to each pixel within a frame-time;

c. means for dividing the frame-time into a set of subframes which collectively develop a predetermined grayscale according to the weighted data bits such that one of the weighted data bits is provided to each pixel during one of the subframes and further wherein each of the pixels is controlled by an appropriate one of the weighted data bits during an entire duration of a first portion of the subframes and during a partial duration of a second portion of the subframes;

c. means for providing a turn-off signal at an end of each subframe;

d. means for inhibiting the turn-off signal for two consecutively asserted bits; and e. means for disabling the means for inhibiting for the second portion of the subframes.

3. The apparatus according to claim 2 wherein the second portion of the subframes each includes an active period and a dead period, the apparatus further including means for disabling the pixel during the dead period.

4. The apparatus according to claim 3 wherein eight subframes comprise the set of subframes.

5. The apparatus according to claim 4 wherein the first portion of subframes includes five subframes wherein a second subframe has half the duration of a first subframe, a third subframe has half the duration of the second subframe, a fourth subframe has half the duration of the third subframe and a fifth subframe has half the duration of a fourth subframe and wherein the second portion of subframes includes three subframes wherein a sixth subframe, a seventh subframe and an eighth subframe each have a duration equal to the fifth subframe and wherein the sixth subframe has an active period half the duration of the fifth subframe, the seventh subframe has an active period one-quarter the duration of the fifth subframe, the eighth subframe has an active period one-eighth the duration of the fifth subframe.

6. The apparatus according to claim 5 wherein the frame-time is equal to an original frame duration.

7. An apparatus for forming a weighted grayscale display, comprising:

a. an array of pixels arranged in a plurality of rows each having a like number of pixels;

b. a row select circuit for selecting a predetermined one of the rows;

c. a plurality of registers coupled to provide a weighted data bit to each pixel into the predetermined one of the rows;

d. a control circuit coupled to the registers and including:

(1) means for loading each of the registers with an appropriate weighted data bit;

(2) means for providing a control signal for transferring the weighted data bits to the predetermined one of the rows;

(3) means for transferring a predetermined number of the weighted data bits for developing a predetermined grayscale within a frame-time to each pixel; and (4) means for dividing the frame-time into a plurality of subframes such that one of the predetermined number of weighted data bits is provided to each pixel during one of the subframes and further wherein each of the pixels is controlled by an appropriate one of the weighted data bits during an entire duration of a first portion of the subframes and during a partial duration of a second portion of the subframes wherein the second portion of the subframes each includes an active period and a dead period, the apparatus further including means for disabling the pixel during the dead period;

e. means for providing a turn-off signal at an end of each subframe;

f. means for inhibiting the turn-off signal for two consecutively asserted bits; and g. means for disabling the means for inhibiting for the second portion of the subframes.

8. The apparatus according to claim 7 wherein the second portion of the subframes each includes an active period and a dead period, the apparatus further including means for disabling the pixel during the dead period.

9. The apparatus according to claim 8 wherein eight subframes comprise the set of subframes.

10. The apparatus according to claim 9 wherein the first portion of subframes includes five subframes wherein a second subframe has half the duration of a first subframe, a third subframe has half the duration of the second subframe, a fourth subframe has half the duration of the third subframe and a fifth subframe has half the duration of a fourth subframe and wherein the second portion of subframes includes three subframes wherein a sixth subframe, a seventh subframe and an eighth subframe each have a duration equal to the fifth subframe and wherein the sixth subframe has an active period half the duration of the fifth subframe, the seventh subframe has an active period one-quarter the duration of the fifth subframe, the eighth subframe has an active period one-eighth the duration of the fifth subframe.

11. A method of providing a grayscale display having a plurality of pixels each having an "on" state and an "off" state comprising the steps of:

a. providing a frame time each having a plurality of subframes times;

b. providing a plurality of data bits, one per pixel, to control the state of each pixel during each subframe time; and c. controlling a time duration of each data bit to provide weighting of the data bits such that each pixel is controlled for the time duration by the data bit during a first portion of the subframes and during a partial duration of a second portion of the subframes;

d. providing a turn-off signal at an end of each subframe;

e. inhibiting the turn-off signal for two consecutively asserted bits; and f. disabling the step of inhibiting for the second portion of the subframes.

* * * * *

UNITED STATES PATENT AND TRADEMARK OFFICE

CERTIFICATE OF CORRECTION

PATENT NO. : 5,798,743

DATED : August 25, 1998

INVENTOR(S) : David M. Bloom

It is certified that error appears in the above-identified patent and that said Letters Patent is hereby corrected as shown below:

IN THE DRAWINGS

Replace Figure 4 on drawing sheet 2 of 2 with the attached substitute Figure 4.

IN THE SPECIFICATION

In Column 4, line 34, delete "1 10" and insert --110--.

IN THE CLAIMS

In Claim 11, line 55, delete "and".

Signed and Sealed this

Twenty-third Day of March, 1999

*Attest:*

Q. TODD DICKINSON

*Attesting Officer*

*Acting Commissioner of Patents and Trademarks*